United States Patent [19]

Ohike et al.

[11] Patent Number: 5,076,156

[45] Date of Patent: Dec. 31, 1991

[54] GRAIN CLEANING MACHINE

[75] Inventors: Tatsuo Ohike; Mitsuo Hino; Shigeaki Yamahara, all of Osaka, Japan

[73] Assignee: Kubota Corporation, Osaka, Japan

[21] Appl. No.: 588,439

[22] Filed: Sep. 26, 1990

[30] Foreign Application Priority Data

Jan. 23, 1990 [JP] Japan ..... 2-14608
May 28, 1990 [JP] Japan ..... 2-138082

[51] Int. Cl.[5] ..... B02B 3/00; B02B 3/04; B02B 7/02

[52] U.S. Cl. ..... 99/488; 99/519; 99/524; 99/606; 99/611; 241/35

[58] Field of Search ..... 134/42; 99/488, 489, 99/518, 519, 523, 524, 525, 528, 600–607, 609–611, 612–615, 617; 241/33, 35

[56] References Cited

U.S. PATENT DOCUMENTS

| | | | |
|---|---|---|---|
| 1,020,377 | 3/1912 | Walker | 99/606 |
| 1,624,831 | 4/1927 | Geddes | 99/488 |
| 2,460,769 | 2/1949 | Schwarz | 99/611 |
| 2,618,307 | 11/1952 | Keller | 99/606 |
| 3,179,140 | 4/1965 | Satake | 99/488 |
| 4,292,890 | 10/1981 | Salete-Garces | 99/617 |
| 4,515,075 | 5/1985 | Satake | 99/519 |
| 4,540,286 | 9/1985 | Satake et al. | 99/488 |
| 4,583,455 | 4/1986 | Salete-Garces | 99/519 |
| 4,843,957 | 7/1989 | Satake | 99/524 |

FOREIGN PATENT DOCUMENTS

| | | |
|---|---|---|
| 62-227454 | 10/1987 | Japan . |
| 112542 | 3/1989 | Japan . |

*Primary Examiner*—Timothy F. Simone
*Attorney, Agent, or Firm*—Webb, Burden, Ziesenheim & Webb

[57] ABSTRACT

A grain cleaning machine comprising a cleaning chamber including a cleaning roll for cleaning uncleaned grain white, a screw conveyor for feeding the uncleaned grain into the cleaning chamber, a discharge adjusting device disposed in a grain outflow region of the cleaning chamber, and a torque sensor for detecting an internal load of the cleaning chamber. The discharge adjusting device is spring-loaded in a direction to stop outflow of white grain from the cleaning chamber, and is movable against the spring load in a direction to enhance outflow of the white grain. The discharge adjusting device is controllable on the basis of torque detection by the torque sensor to maintain the internal load of the cleaning chamber in a predetermined value.

11 Claims, 10 Drawing Sheets

GRAIN CLEANING MACHINE

BACKGROUND OF THE INVENTION

1. Field of the Invention

The present invention relates to a grain cleaning machine, and a method of controlling the grain cleaning machine, in which a cleaning chamber housing a rotatable cleaning roll has an outlet opened to discharge cleaned grain when an internal load of the cleaning chamber exceeds a predetermined spring load.

2. Description of the Prior Art

A conventional grain cleaning machine is constructed as shown in FIG. 10.

This machine has a grain cleaning housing 501 including a feed roll 502 and a cleaning roll 503. A baffle 504 is disposed at a grain outlet 507 of the housing 501 for restricting a sectional area of a passage through the outlet. A grain cleaning operation is carried out by rotating the feed roll 502 and cleaning roll 503 by means of a motor 505. The feed roll 502 transports uncleaned grain such as rice 506 delivered from above toward the baffle 504. The rice is cleaned between a screen 509 mounted inside the cleaning housing 501 and the rotating cleaning roll 503. Cleaned white rice is discharged through the grain outlet 507. When the grain outlet 507 is opened to a small extent, the cleaning housing 501 has an increased internal load to whiten the rice to a high degree. When the grain outlet 507 is opened to a large extent, the cleaning housing 501 has a small internal load to whiten the rice to a low degree.

Conventionally, the baffle 504 is biased by a spring 508 in a direction to close the grain outlet 507 in order to maintain a constant whitening degree. The grain outlet 507 is opened to a larger extent when the rice under treatment applies a force exceeding the spring load to the baffle 504, thereby to discharge rice whitened to a desired degree from the cleaning housing 1.

However, skill is required and operability is poor where a desired degree of whiteness is obtained by adjusting the biasing force of the spring 508.

A technique of automatically varying the biasing force of the spring 508 is known from Japanese Patent Publication No. 1989-12542. According to this technique, a current flowing to the motor 505 is detected through a current transformer, and an actuator (not shown) is provided to vary the biasing force of the spring 508 for causing the detected current level to approach a predetermined value for realizing a desired degree of whiteness.

However, the control based on the current level cannot assure high precision because of source voltage variations and variations in the characteristics of the motor 505.

Further, although the degree of whiteness is automatically controlled by the prior art technique, no means is provided for determining and displaying completion of a grain cleaning operation with a small quantity of uncleaned grain remaining in the cleaning housing 1. In practice, the motor 5 is run in spite of the cleaning operation having been completed, and is stopped only when the operator feels that the grain is sufficiently cleaned. With known grain cleaning machines, uncleaned grain fed at the start of a cleaning operation is discharged without being cleaned. To cope with such a situation, Japanese Patent Publication Kokai No. 1987-227454 discloses a grain cleaning machine including a recirculating passage specially provided for feeding a first discharge of uncleaned grain back to the machine.

The illustrated horizontal type grain cleaning machine known in the art has the spring 508 applying a constant biasing force from beginning to end of a cleaning operation. As a consequence, when the cleaning operation draws toward the end, the degree of whiteness becomes insufficient and the uncleaned grain 506 remains in the cleaning housing 501 without being discharged since the uncleaned grain is fed in a reduced amount to the cleaning housing 1 toward the end of the operation. In the case of a vertical type cleaning machine in which gravity is operable, a desired degree of whiteness cannot be obtained when the cleaning chamber has a reduced internal load toward the end of a cleaning operation. If the baffle 504 is opened to allow grain to flow through the grain outlet 507, insufficiently cleaned grain will be discharged from the machine.

SUMMARY OF THE INVENTION

An object of the present invention is to provide a grain cleaning machine capable of cleaning grain reliably and to varied degrees of whiteness.

Another object of the invention is to eliminate the inconveniences encountered in the initial and final stages of a grain cleaning operation by conventional grain cleaning machines.

The above objects are fulfilled, according to the present invention by a grain cleaning machine comprising a cleaning chamber including a cleaning roll for cleaning uncleaned grain white, an uncleaned grain feeding device for feeding the uncleaned grain into the cleaning chamber, a discharge adjusting device disposed in a grain outflow region of the cleaning chamber, a torque sensor for detecting an internal load of the cleaning chamber, and a control device operable in response to a detection value provided by the torque sensor to control the discharge adjusting device thereby to maintain the internal load of the cleaning chamber in a predetermined value.

In a further aspect of the invention, a method of controlling the above grain cleaning machine is provided which comprises the steps of selecting a degree of whiteness of grain, feeding uncleaned grain into the cleaning chamber, setting a biasing force based on the selected degree of whiteness, detecting the internal load of the cleaning chamber by means of a torque sensor, adjusting the biasing force of the biasing device in accordance with a detection value provided by the torque sensor in order to maintain the internal load in a level corresponding to the selected degree of whiteness, and determining an end of supply of the uncleaned grain to be whitened when the detection value provided by the torque sensor shows a predetermined internal load condition of the cleaning chamber.

The grain cleaning technique according to the present invention is based on the finding that a reliable grain cleaning operation may be realized by accurately monitoring the internal load of the cleaning chamber. The invention has succeeded in detecting the internal load reliably and with high precision by utilizing a torque sensor.

Where grain is cleaned to varied degrees of whiteness, a uniform quality of white grain is obtained according to a selected degree of whiteness. This is made possible by monitoring torque detection by the torque sensor and maintaining the internal load of the cleaning chamber in a very precise level corresponding to the selected degree of whiteness.

As will be apparent from the description of the preferred embodiment, the inconveniences encountered in the initial and final stages of a grain cleaning operation with the conventional machine are eliminated by using the torque detected by the torque sensor as a trigger for adjusting supply of uncleaned grain and outflow of cleaned grain. For this purpose, the cleaning operation according to the present invention is divided into an initial cleaning process, a main cleaning process and a final cleaning process. Controls for each cleaning process are effected by monitoring the internal load of the cleaning chamber, i.e. the detection value provided by the torque sensor.

Other objects, features and advantages of the present invention will be apparent from the following description.

DESCRIPTION OF THE PREFERRED EMBODIMENT

An embodiment of the present invention will be described hereinafter with reference to FIGS. 1 and 2.

Figure 1:
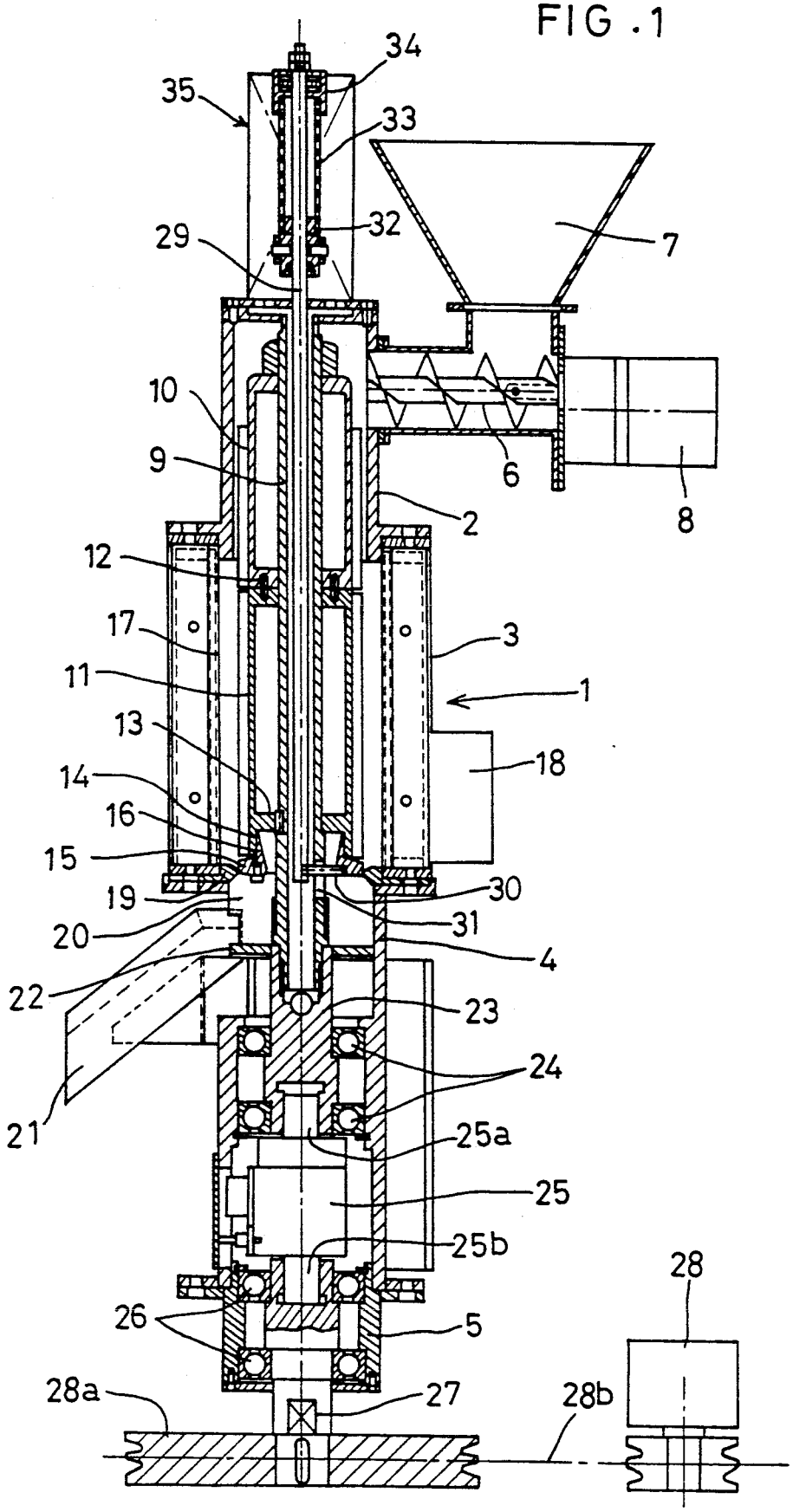
FIG. 1 is an overall view in vertical section of a grain cleaning machine.

Referring to FIG. 1, a grain cleaning machine comprises a main casing body 1 including an upper casing 2, a tubular cleaning section 3, an intermediate casing 4 and a lower bearing casing 5 coaxially connected to one another in succession from top to bottom. The upper casing 2 defines an opening in an upper side wall thereof to which a screw conveyor 6 is connected for feeding uncleaned grain such as rice. Numeral 7 denotes a hopper for supplying uncleaned rice to the screw conveyor 6, and numeral 8 denotes a motor for driving the screw conveyor 6.

A hollow rotary shaft 9 extends axially through the upper casing 2 and tubular cleaning section 3 down to an upper position in the intermediate casing 4. The rotary shaft 9 carries a feed roll 10 mounted thereon in a region inside the upper casing 2, and a cleaning roll 11 mounted in a region inside the tubular cleaning section 3. The feed roll 10 and cleaning roll 11 are interconnected by coupling pins 12, and the cleaning roll 11 is engaged at positions adjacent a lower end thereof circumferentially with the rotary shaft 9 by means of keys 13.

The cleaning roll 11 includes a cylindrical recess 14 defined in the lower end thereof, and a fitting tube 16 extending upwardly from an opening degree limiting member 15 is vertically slidably inserted into the cylindrical recess 14. The opening degree limiting member 15 has an outer periphery defining a cylindrical surface having a suitable vertical width. The fitting tube 16 has an edged top from which an inside peripheral surface thereof is tapered downwardly as spaced from an outer periphery of the rotary shaft 9. The fitting tube 16 scrapes off bran adhering to peripheral surfaces of the cylindrical recess 14 defined in the lower end of the cleaning roll 11, without trapping the bran between a bottom surface of the cylindrical recess 14 and the top of the fitting tube 16.

The tubular cleaning section 3 houses a screen 17 suitably spaced from the outer periphery of the cleaning roll 11. The cleaning section 3 includes a discharge opening 18 defined in a lower side wall thereof for discharging the bran produced during a grain cleaning operation. Further, a cleaned grain outlet defining member 19 is disposed between the lower end of the cleaning section 3 and the upper end of the intermediate casing 4. The cleaned grain outlet defining member 19 has an inside periphery formed into a knife edge contacting the outer peripheral surface of the opening degree limiting member 15 having a suitable vertical width.

The intermediate casing 4 includes a cleaned grain discharge opening 20 defined in an upper side wall thereof to which a chute 21 is connected. A guide plate 22 projects from the rotary shaft 9 for receiving cleaned rice falling from the grain outlet defining member 19, and guiding the cleaned rice into the chute 21. The intermediate casing 4 houses an intermediate shaft 23 mounted in an intermediate portion thereof and rotatably supported by upper and lower bearings 24, the intermediate shaft 23 being fixed to a lower end of the rotary shaft 9. The intermediate casing 4 further houses a torque sensor 25 mounted in a lower portion thereof. The torque sensor 25 includes a shaft portion **25*a* projecting from an upper end thereof and axially slidably but not relatively rotatably fitted in the intermediate shaft 23**.

The lower bearing casing 5 houses a drive shaft 27 rotatably supported by upper and lower bearings 26. The drive shaft 27 has an upper end axially slidably but not relatively rotatably fitted on a shaft portion **25*b* projecting from a lower end of the torque sensor 25. A pulley 28*a* is fixed to a lower end of the drive shaft 27. This pulley 28*a* is driven by a motor 28 only schematically shown, through a drive belt 28*b***.

An opening degree adjusting shaft 29 extends through the hollow rotary shaft 9. This adjusting shaft 29 is connected at a lower end thereof to the opening degree limiting member 15 through a connecting element 30 extending through a slot 31 defined in the hollow rotary shaft 9. The upper end of the opening degree adjusting shaft 29 is relatively rotatably engaged with an upper face of an engaging element 34 supported by a lift element 32 through a spring 33. The lift element 32 is vertically movable by a raising and lowering device 35 which is only schematically shown in FIG. 1 but shown in detail in FIG. 2.

Figure 2:
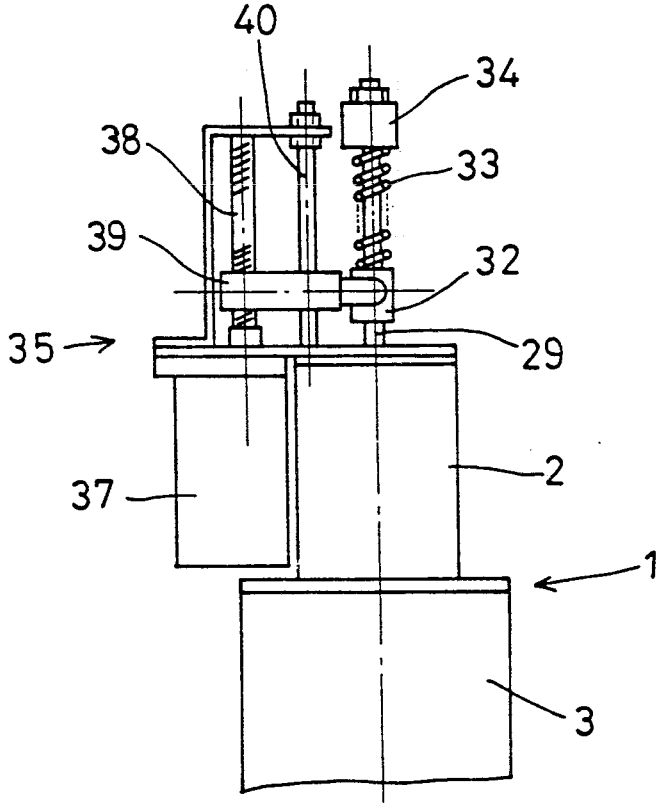
FIG. 2 is a side view of a device for varying a biasing force applied to an opening degree limiting member.

As shown in FIG. 2, the raising and lowering device 35 includes a feed screw shaft 38 rotatable by a drive motor 37, a movable nut 39 meshed with the screw shaft 38, and a guide rod 40 for guiding the nut 39 which is connected to the lift element 32. Thus, the raising and lowering device 35 is operable to adjust the biasing force of the spring 33.

With the grain cleaning machine as constructed above, uncleaned rice is fed from the hopper 7 through the screw conveyor 6 into the upper casing 2, with the rotary shaft 9 rotated by the motor 28 through the drive shaft 27 and torque sensor 25. Then the uncleaned rice is forced into the tubular cleaning section 3 by the feed roll 10, to be treated between the rotating cleaning roll 11 and screen 17. The bran produced as a result of the cleaning operation is discharged with air introduced into the rotary shaft 9 and flowing out through air vents (not shown) defined in the rotary shaft 9 and cleaning roll 11 and through the screen 17 toward the discharge opening 18. Cleaned rice is successively moved under a pressure inside the space between the screen 17 and cleaning roll 11 in the tubular cleaning section 3, i.e. internal pressure of the cleaning chamber, through an annular outlet formed between the grain outlet defining member 19 and the outer periphery of the opening degree limiting member 15 pushed downwardly against the biasing force of spring 33 adjusted by the raising and lowering device 35. The cleaned rice is then discharged from the cleaned grain discharge opening 20 through the chute 21. The internal pressure of the cleaning chamber is detected by the torque sensor 25 as an internal load of the cleaning chamber acting on the rotary shaft 9.

Figure 3:
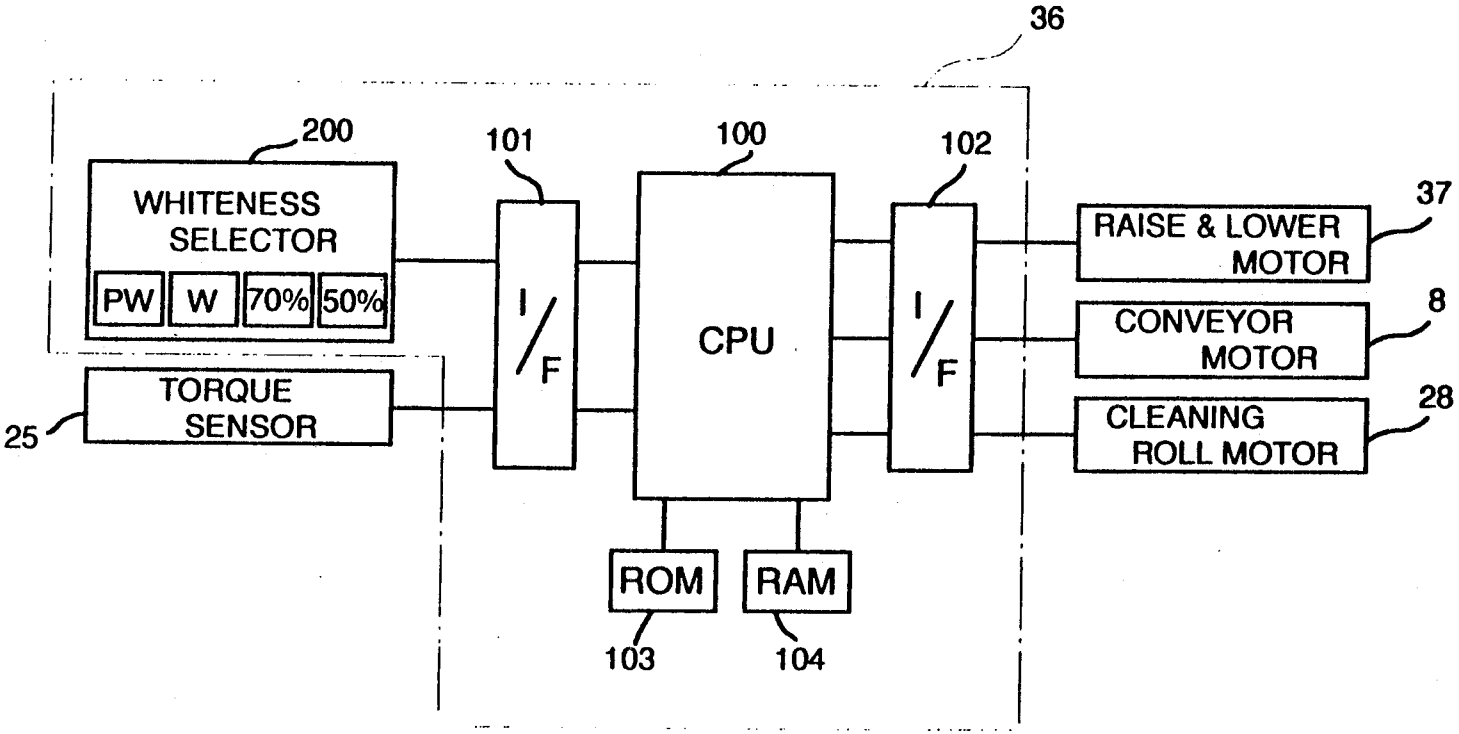
FIG. 3 is a block diagram of a control system.

FIG. 3 is a block diagram of a control system of the grain cleaning machine according to the present invention. This control system comprises a control device 36 which plays a central part in controlling the machine, and which receives a signal from the torque sensor 25 and outputs control signals to the motor 8 for driving the screw conveyor 6, the motor 37 for driving the raising and lowering device 35, and the motor 28 for driving the rotary shaft 9, i.e. the feed roll 10 and cleaning roll 11. The control device 36 employs an ordinary control method carried out through a microcomputer, and includes a CPU 100, a ROM 103, a RAM 104, an input interface 101, and an output interface 102. In addition, a whiteness selector 200 is provided for selecting a degree of whiteness in order to allow the grain cleaning machine to whiten rice to varied degrees. In this example, the whiteness selector 200 has four available modes, i.e. a "pure white" mode, a "white" mode, a "70 percent polish" mode and a "50 percent polish" mode. Of course, the degree of whiteness may be selected steplessly instead.

In response to the torque detection signal transmitted from the torque sensor 25 and a whitening mode selected through the whiteness selector 200, the CPU 100 carries out arithmetic operations in accordance with a control algorithm stored in the ROM 103. Then the CPU 100 outputs the control signals to the motor 8 for driving the screw conveyor 6, the motor 37 for driving the raising and lowering device 35, and the motor 28 for driving the rotary shaft 9, to control the grain cleaning operation.

The manner in which the grain cleaning machine according to the present invention is controlled will be described with reference to the flowcharts shown in FIGS. 4 through 8.

Figure 4:
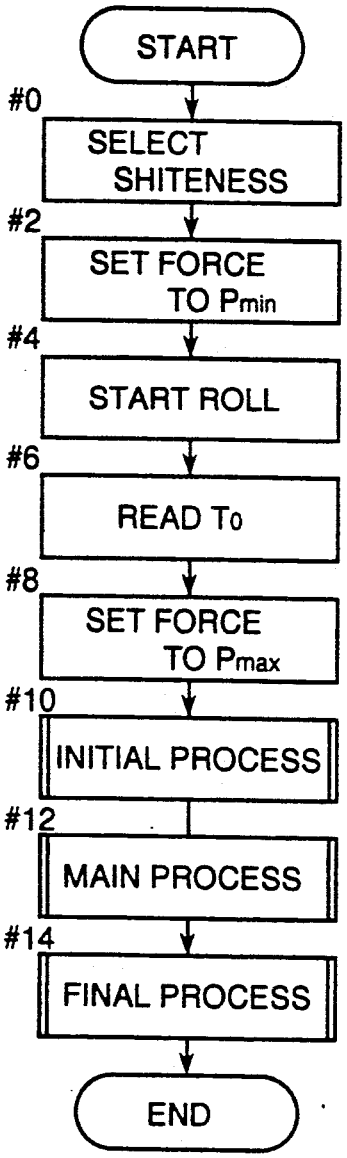
FIGS. 4 through 8 are flowcharts showing control flows.

FIG. 4 shows a main control routine of the cleaning machine. First, the operator selects a desired degree of whiteness, i.e. a whiteness mode (step #0), and presses a start button to start a cleaning operation. Then, the raising and lowering device 35 is driven to adjust the biasing force of the spring 33 for setting a Pmin biasing force to the opening degree adjusting shaft 29 (step #2). The motor 28 is driven to rotate the cleaning roll 11 and feed roll 10 (step #4). In this state, a detection value of the torque sensor 25, i.e. no-load torque T0, is received and stored at a predetermined address in the RAM 104 (step #6). The detection by the torque sensor 25 actually is repeated at suitable intervals of time by a torque detection interrupt process which will be described later, and each detected value is stored at the predetermined address in the RAM 104 after a suitable arithmetic operation. In the control routine, therefore, the detected torque values may be read from the RAM 104. Next, the force applied to the opening degree adjusting shaft 29 is set to Pmax which is higher than Pmin. (step #8). Then, a substantive cleaning operation is commenced. This operation is divided into an initial cleaning process (step #10), a main cleaning process (step #12) and a final cleaning process (step #14).

Figure 5:
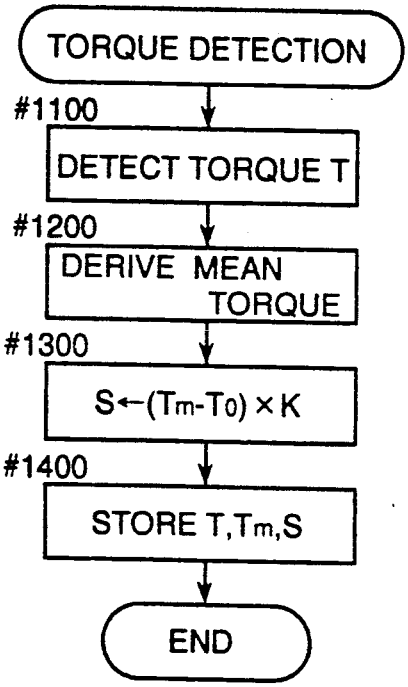

As shown in FIG. 5, the torque detection interrupt process noted above starts with receipt of a detected torque T from the torque sensor 25 (step #1100). A mean torque Tm is derived by the moving average method, from this torque and detected torque values received previously (step #1200). A threshold level S is calculated by subtracting the no-load torque T0 received at step #4 from the mean torque Tm and multiplying the result by a coefficient K (step #1300). These values T, Tm and S are stored at predetermined addresses in the RAM 104 (step #1400).

Figure 6:
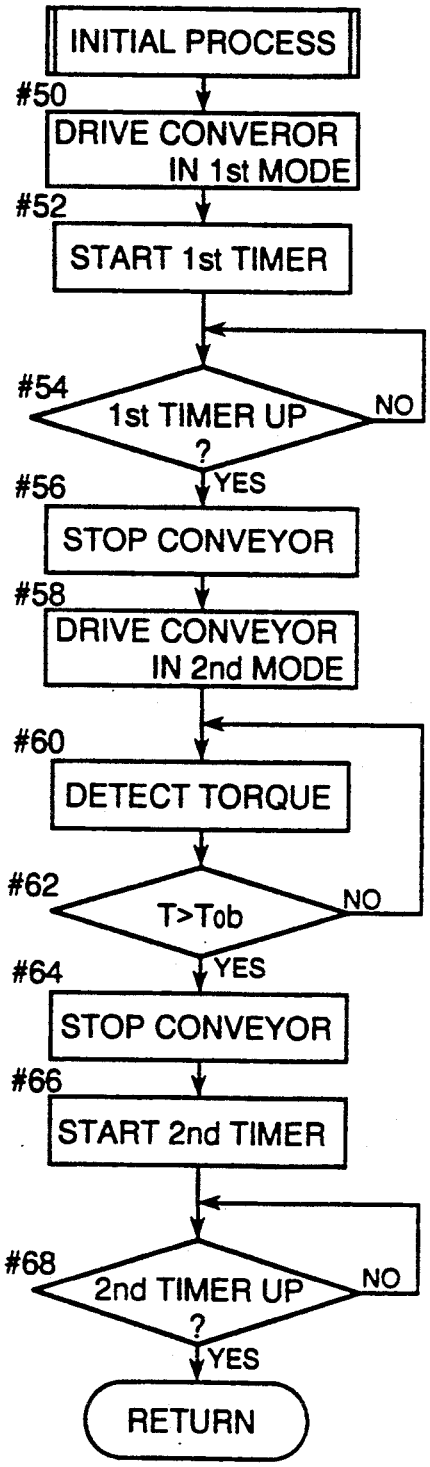

The initial cleaning process will be described next with reference to FIG. 6.

First, the screw conveyor 6 is driven in a first mode for transporting a large quantity of uncleaned rice (step #50), to feed the uncleaned rice from the hopper 7 to the interior of the tubular cleaning section 3, i.e. the cleaning chamber. After lapse of a period of time set by a first timer for substantially filling the cleaning chamber with the uncleaned rice supplied (steps #52 and #54), the screw conveyor 6 is stopped (step #56). Subsequently, the screw conveyor 6 is driven in a second mode for transporting a small quantity of uncleaned rice (step #58). The torque detected by the torque sensor 25 is compared with a predetermined reference value T0*b* (steps #60 and #62). If the detected torque exceeds the reference value T0*b*, the screw conveyor 6 is stopped since the cleaning chamber is filled up with uncleaned rice (step #64). The rice is cleaned in the cleaning chamber for a period of time set by a second timer (steps #66 and #68). The screw conveyor 6 should preferably be driven continuously in the first mode and intermittently in the second mode. Instead, the screw conveyor 6 may be driven at high speed in the first mode and at low speed in the second mode. Further, it is possible to drive the screw conveyor 6 in the first mode not for the period set by the first timer but until the internal load of the cleaning chamber monitored through the torque sensor 25 reaches a predetermined load level or torque.

The biasing force acting on the opening degree adjusting shaft 29 is set high for the initial cleaning process, and therefore uncleaned rice is not discharged during this process. The rice cleaned during this period is discharged through the discharge outlet formed between the opening degree limiting member 15 and rice outlet defining member 19. This discharge outlet is formed when the screw conveyor 6 resumes supply of uncleaned rice for the subsequent main cleaning process, with the opening degree adjusting shaft 29, i.e. the opening degree limiting member 15, being lowered under the pressure of the uncleaned rice in the cleaning chamber.

Figure 7A:
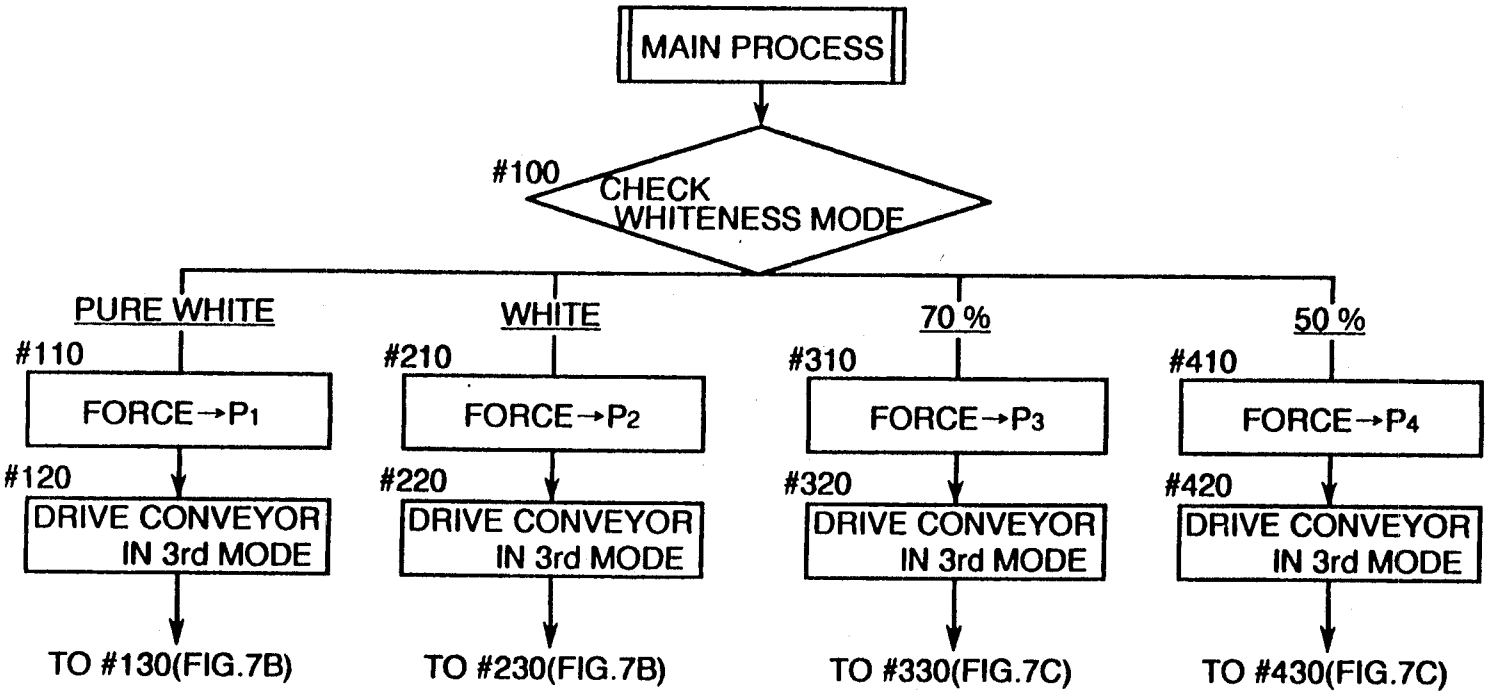
Figure 7B:
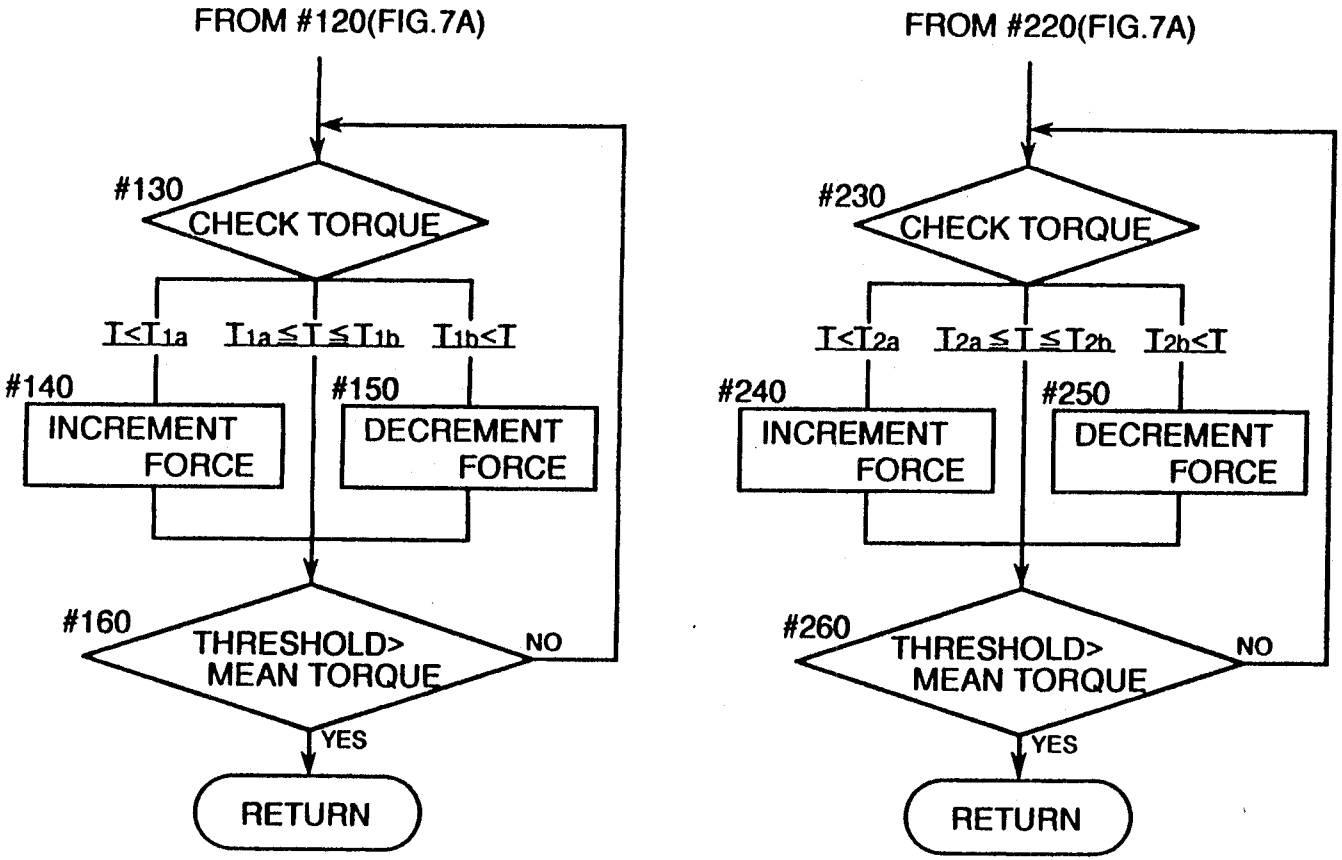
Figure 7C:
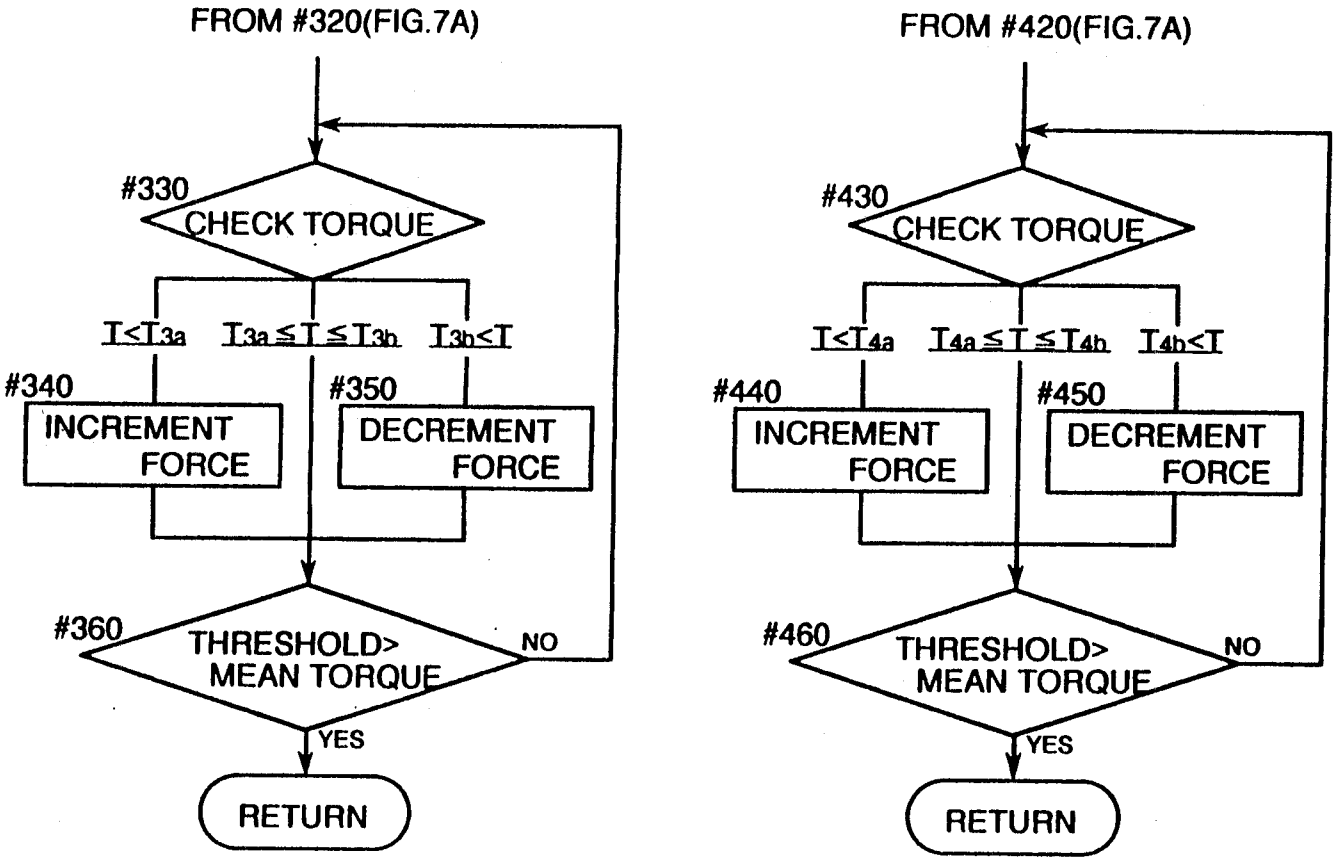

The main cleaning process will be described next with reference to FIGS. 7A through 7C.

First, checking is made as to which whitening mode is selected through the whiteness selector 200 (step #100). Steps #110 through #160 are executed for the "pure white" mode, steps #210 through #260 for the "white" mode, steps #310 through #360 the "70 percent polish" mode, and steps #410 through #460 for the "50 percent polish" mode. When the "pure white" mode is selected, for example, the motor 37 of the raising and lowering device 35 is driven to set the biasing force of the spring 33 to P1 suited to the "pure white" mode, which is to be applied to the opening degree adjusting shaft 29 (step #110). Next, the screw conveyor 6 is driven in a third mode to start feeding further uncleaned rice (step #120). The drive in the third mode is a continuous, steady-state drive of the screw conveyor 6, and specifications of the motor for driving the screw conveyor 6 normally is determined on the basis of the load and the like occurring during such operation. In the cleaning process commenced in this mode, the torque detected by the torque sensor 25 is compared with a lower limit T1*a* and an upper limit T1*b* of a reference torque range for the "pure white" mode (step #130). This step is taken in order to correctly control the internal load of the cleaning chamber. Rice may be cleaned to a desired degree of whiteness by so controlling the internal load because there is a correlation between the degree of whiteness of the cleaned rice and the internal load of the cleaning chamber, i.e. the detected torque, occurring at the cleaning time. If the detected torque T is below the lower limit T1*a*, the raising and lowering device 35 is controlled to increment the biasing force applied to the opening degree adjusting shaft (step #140). If the detected torque T is above the upper limit T1*b*, the raising and lowering device 35 is controlled to decrement the biasing force applied to the opening degree adjusting shaft (step #150). If the detected torque T is between the lower limit T1*a* and upper limit T1*b*, the biasing force applied to the opening degree adjusting shaft is maintained as it is. That is, the torque T detected by the torque sensor 25 exceeds the upper limit T1*b* when the internal load of the cleaning chamber increases to apply a greater torque load to the cleaning roll 11. In this case, the control device 36 outputs the control signal to drive the raising and lowering device 35 for lowering the lift element 32. As a result, the upwardly urging force of the spring 33 applied to the opening degree adjusting shaft 29 is reduced whereby the adjusting shaft 29, and thus the opening degree limiting member 15 is lowered to enlarge a sectional passage area of the discharge outlet defined between the opening degree limiting member 15 and outlet defining member 19. This reduces the internal load of the cleaning chamber. Conversely, when the internal load of the cleaning chamber is small, the sectional passage area of the discharge outlet is reduced through a similar sequence, to increase the internal load of the cleaning chamber. By maintaining the torque detected by the torque sensor 25 constant in this way, the rice is cleaned to a desired degree of whiteness, that is white rice corresponding to a selected whitening mode. If, during the main cleaning process, the mean torque Tm falls below the threshold level S, all the uncleaned rice placed in the hopper 7 is regarded as having been supplied to the cleaning chamber, there being no further supply of rice (step #160). Then the main cleaning process is ended to be followed by the final cleaning process.

The main cleaning process in the other modes is carried out as in the "pure white" mode. In the "white" mode, however, the biasing force is set to P2 at step #210, and the lower and upper limits are changed to T2*a* and T2*b*, respectively, for comparison with the detected torque made at step #230. Similarly, in the "70 percent polish" mode, the biasing force is set to P3 at step #310, and the lower and upper limits are changed to T3*a* and T3*b*, respectively, for comparison with the detected torque made at step #330. In the "50 percent polish" mode, the biasing force is set to P4 at step #340, and the lower and upper limits are changed to T4*a* and T4*b*, respectively, for comparison with the detected torque made at step #430.

Figure 8:
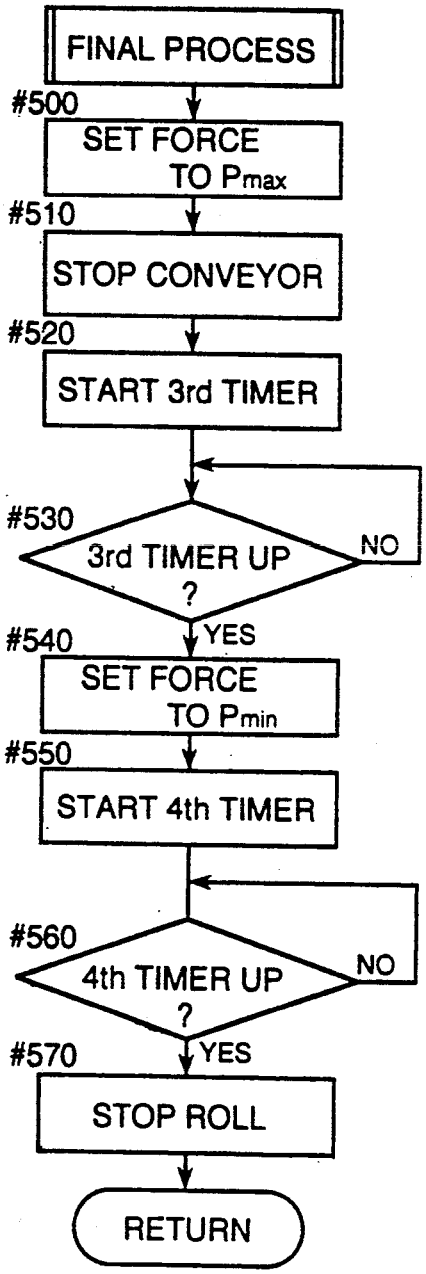

The final cleaning process will be described next with reference to FIG. 8.

First, the raising and lowering device 35 is controlled to increase the biasing force applied to the opening degree adjusting shaft 29, e.g. to set the force to Pmax (step #500). Then, the screw conveyor 6 is stopped (step #510). Since the biasing force applied to the opening degree adjusting shaft 29 is increased sharply, the sectional passage area of the discharge outlet is reduced to check outflow of white rice. In this state, a cleaning operation is carried out by rotating the cleaning roll 11 for a period of time set by a third timer (steps #520 and #530). Thereafter, when the rice in the cleaning chamber is substantially cleaned, the biasing force applied to the opening degree adjusting shaft 29 is reduced, for example, to Pmin (step #540). Then, the opening degree adjusting shaft 29 is lowered thereby to enlarge the sectional passage area of the discharge outlet for discharging white rice from the cleaning chamber. A fourth timer is set in advance to provide a period for completely discharging the white rice out of the cleaning chamber. When this period expires (step #560), the rotary shaft 9 is stopped to stop the feed roll 10 and cleaning roll 11 (step #570). This completes the series of cleaning processes.

Figure 9:
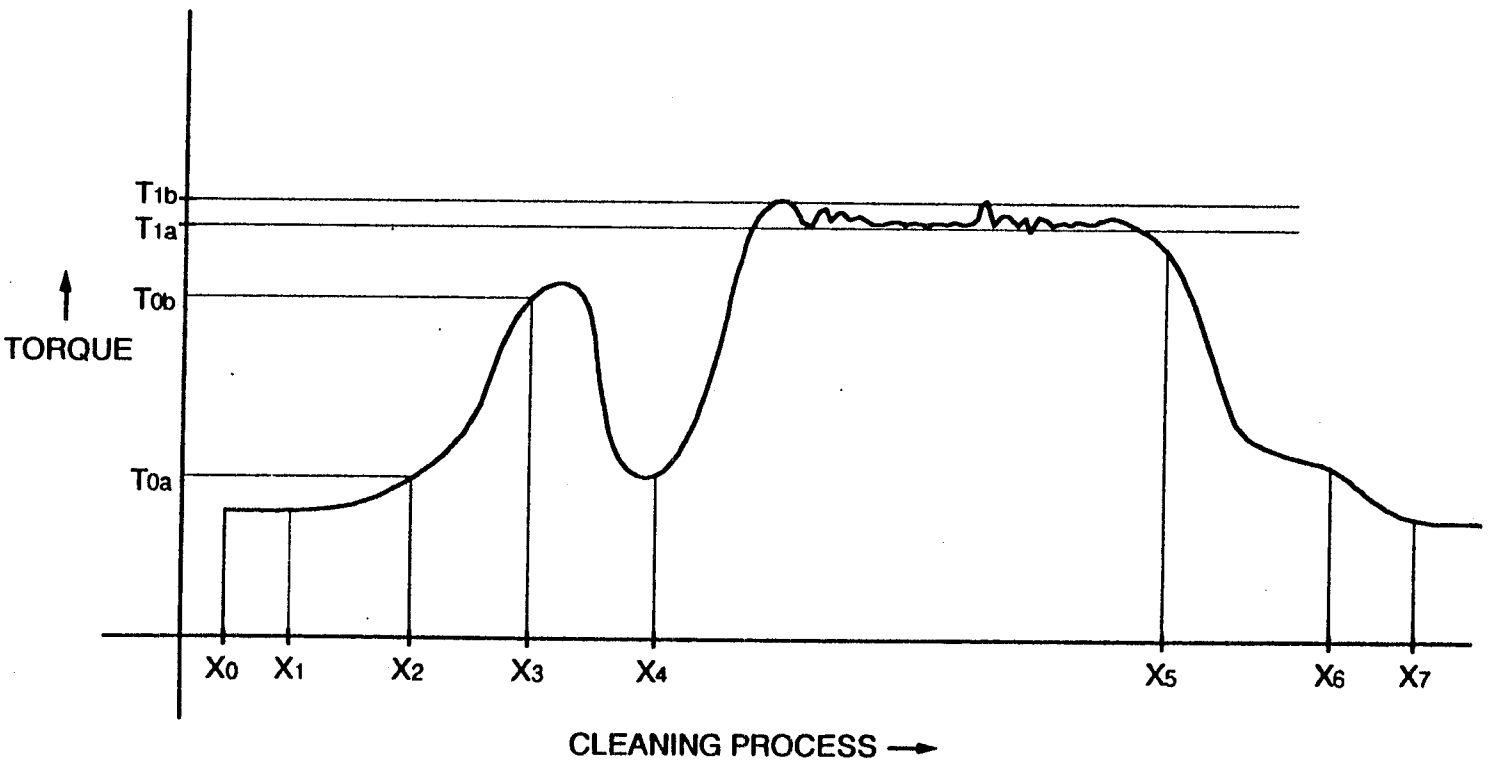
FIG. 9 is a graph showing a relationship between grain cleaning process and torque detected by a torque sensor.
Figure 10:
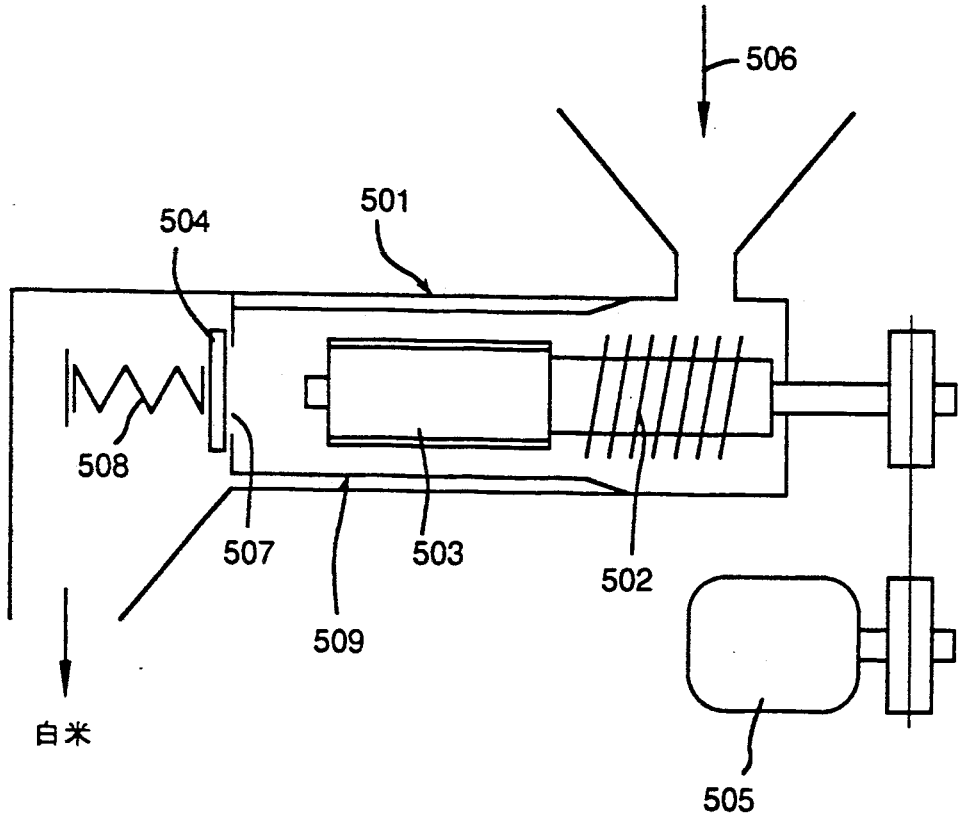
FIG. 10 is a schematic view of a conventional grain cleaning machine.

As described above, the grain cleaning machine according to the present invention cleans rice to a desired degree of whiteness by suitably setting a biasing force applied to the opening degree adjusting shaft 29, then monitoring the internal load of the cleaning chamber through the torque sensor 25, and maintaining the internal load in an appropriate level. Further, the cleaning operations in the initial and final stages which have been difficult in the prior art are improved by setting the biasing force applied to the opening degree adjusting shaft 29 and monitoring the internal load of the cleaning chamber through the torque sensor 25. To facilitate understanding of the control principle, reference is made to the graph of FIG. 9 showing a relationship between grain whitening process and torque detected by the torque sensor.

At a point of time X0, the cleaning machine is operating with no load. At a point of time X1, the Pmax biasing force is applied to the opening degree adjusting shaft 29, and the screw conveyor 6 begins feeding uncleaned rice. The detected torque gradually increases and, at a point of time X2, reaches a value T0*a* corresponding to the internal load of the cleaning chamber enabling cleaning of the rice, whereupon the initial cleaning process is started. At a point of time X3, the detected torque reaches a value T0*b* whereupon the screw conveyor 6 is stopped for a predetermined period of time, and the initial cleaning process continues with the supply of uncleaned rice and discharge of white rice stopped. With progress of the cleaning operation, the rice is stripped of bran and the detected torque decreases gradually. At a point of time X4, the main cleaning process is started, and a biasing force corresponding to a selected whiteness mode is applied to the opening degree adjusting shaft 29, with the rotation of the screw conveyor 6 resumed. The detected torque increases with supply of uncleaned rice into the cleaning chamber. The cleaning process is continued while the biasing force applied to the opening degree adjusting shaft 29 is controlled to keep the detected torque between the reference torque values T1*a* and T1*b* corresponding to the selected whiteness mode. When uncleaned rice to be treated has all been treated and no further rice is supplied to the cleaning chamber, the detected torque begins to lower. At this time, i.e. at a point of time X5, the biasing force applied to the opening degree adjusting shaft 29 is increased to Pmax for the final cleaning process with discharge of white rice through the discharge outlet under check. When the operator judges that the rice in the cleaning chamber has been cleaned, i.e. at a point of time X6, the biasing force applied to the opening degree adjusting shaft 29 is reduced to Pmin to allow the whitened rice to exit the cleaning chamber. At a point of time X7, the cleaning operation is completed.

What is claimed is:

1. A grain cleaning machine comprising:

a) a cleaning chamber including a cleaning roll for cleaning uncleaned grain white, b) uncleaned grain feed means for feeding the uncleaned grain into said cleaning chamber, c) adjustable discharge means disposed in a grain outflow region of said cleaning chamber, d) means for detecting a torque of a drive line of said cleaning roll corresponding to an internal load of said cleaning chamber, and e) control means operable in response to a detection value provided by said torque detecting means to control said adjustable discharge means thereby to maintain the internal load of said cleaning chamber in a predetermined value, wherein said control means includes torque setting means for setting a torque for an initial cleaning process, and a timer for the initial cleaning process, said control means being operable to drive said uncleaned grain feed means intermittently or at low speed when said cleaning chamber is substantially filled by said uncleaned grain feed means and until the detection value provided by said torque detecting means exceeds said torque for the initial cleaning process, and thereafter to stop said uncleaned grain feed means for a period of time set by said timer for effecting a cleaning process.

2. A grain cleaning machine as claimed in claim 1, wherein said control means includes whiteness selecting means for selecting a degree of whiteness, said control means being operable to control said adjustable discharge means for maintaining a value of the internal load of said cleaning chamber corresponding to the degree of whiteness selected by said whiteness selecting means.

3. A grain cleaning machine as claimed in claim 1, wherein said adjustable discharge means includes a stationary outer outlet defining member and a movable inner outlet defining member, said outlet defining members defining therebetween a discharge opening having a sectional area variable with movement of said inner outlet defining member.

4. A grain cleaning machine as claimed in claim 3, wherein said inner outlet defining member is biased by biasing means in a direction to close said discharge opening, and is movable under the internal load of said cleaning chamber in a direction to open said discharge opening against force of said biasing means, said control means being operable to vary the force of said biasing means in response to the detection value provided by said torque detecting means.

5. A grain cleaning machine as claimed in claim 4, wherein said biasing means comprises a spring, said control means being operable to vary bias of said spring.

6. A grain cleaning machine as claimed in claim 1, wherein said control means includes a final process determining unit for determining an end of supply of uncleaned grain to be whitened when the detection value provided by said torque detecting means shows a predetermined internal load condition of said cleaning chamber, said control means being operable to effect a cleaning process by temporarily checking discharge of white grain from said cleaning chamber when said final process determining unit determines an end of supply of uncleaned grain, and thereafter to control said adjustable discharge means for allowing discharge of the white grain from said cleaning chamber.

7. A grain cleaning machine as claimed in claim 6, wherein said final process determining unit determines the end of supply of uncleaned grain when the detection value provided by said torque detecting means falls below a predetermined lower limit.

8. A grain cleaning machine as claimed in claim 6, wherein said final process determining unit determines the end of supply of uncleaned grain when the detection value provided by said torque detecting means exceeds a predetermined negative rate of change.

9. A grain cleaning machine as claimed in claim 1, wherein said torque detecting means includes a torque sensor for detecting a torque of a drive shaft of said cleaning roll.

10. A grain cleaning machine as claimed in claim 1, further comprising a drive line attached to said cleaning roll whereby said means for detecting a torque of said cleaning roll detects the torque of said drive line of said cleaning roll, which corresponds to the internal load of said cleaning chamber.

11. A grain cleaning machine comprising;

a) a cleaning chamber including a cleaning roll for cleaning uncleaned grain white, b) means for driving said cleaning roll through a drive shaft, c) uncleaned grain feed means for feeding the uncleaned grain into said cleaning chamber, d) adjustable discharge means disposed in a grain outflow region of said cleaning chamber, said adjustable discharge means including a stationary outer outlet defining member and a movable inner outlet defining member, said outlet defining members defining therebetween a discharge opening having a sectional area variable with movement of said inner outlet defining member, said inner outlet defining member being biased by biasing means in a direction to close said discharge opening, e) a torque sensor for detecting a torque of the drive shaft, f) control means operable in response to a detection value provided by said torque sensor to control said adjustable discharge means, and g) whiteness setting means for transmitting a target torque corresponding to a predetermined degree of whiteness to said control means, wherein said control means transmits a control signal to said adjustable discharge means based on said target torque and a value detected by said torque sensor thereby to vary a biasing force of said biasing means.

* * * * *